United States Patent [19]

Nieda et al.

[11] Patent Number: 4,513,357

[45] Date of Patent: Apr. 23, 1985

[54] HEADLAMP UNIT WITH TIMED SWITCHING BETWEEN TWO LIGHTS

[75] Inventors: Yasuhiro Nieda, Yokosuka; Kiyokazu Honda, Zushi, both of Japan

[73] Assignee: Tokyo Shibaura Denki Kabushiki Kaisha, Kawasaki, Japan

[21] Appl. No.: 571,492

[22] Filed: Jan. 17, 1984

[30] Foreign Application Priority Data

Jan. 19, 1983 [JP] Japan ..... 58-6988
Jan. 19, 1983 [JP] Japan ..... 58-6989

[51] Int. Cl.[3] ..... F21M 15/00

[52] U.S. Cl. ..... 362/228; 362/231; 362/251; 362/802; 362/240; 362/295; 362/372; 362/241; 362/80; 362/83; 315/83; 313/115

[58] Field of Search ..... 362/61, 66, 80, 228, 362/237, 238, 240, 241, 287, 297, 308, 310, 368, 372, 231, 295, 802; 315/82, 83, 86; 313/113, 114, 115, 318

[56] References Cited

U.S. PATENT DOCUMENTS

| | | | |
|---|---|---|---|
| 2,259,107 | 10/1941 | Halvorson | 362/228 |
| 2,343,822 | 3/1944 | Tuck | 362/228 |
| 3,234,421 | 2/1966 | Reiling | 313/114 X |
| 3,553,520 | 1/1971 | Hicks | 313/113 |
| 3,710,097 | 1/1973 | Bright et al. | 362/80 X |
| 4,029,983 | 6/1977 | Thornton | 313/571 X |
| 4,142,228 | 2/1979 | Kumagai et al. | 362/66 X |
| 4,293,893 | 10/1981 | Tsuzuki et al. | 362/66 X |
| 4,377,841 | 3/1983 | Kukla | 362/80 |

FOREIGN PATENT DOCUMENTS

| | | | |
|---|---|---|---|
| 349700 | 12/1960 | Switzerland | 362/228 |

*Primary Examiner*—Peter A. Nelson
*Attorney, Agent, or Firm*—Oblon, Fisher, Spivak, McClelland & Maier

[57] ABSTRACT

A headlamp unit having a high intensity discharge lamp disposed at about the focus of a parabolic reflector and an incandescent lamp disposed at about the focus of a parabolic reflector.

2 Claims, 5 Drawing Figures

HEADLAMP UNIT WITH TIMED SWITCHING BETWEEN TWO LIGHTS

BACKGROUND OF THE INVENTION

1. Field of the Invention

This invention generally relates to a headlamp unit and more particularly to a headlamp unit including both an incandescent lamp and a high intensity discharge lamp.

2. Description of the Prior Art

Incandescent lamps, including halogen lamps having a filament made of a tungsten wire, are widely used as a lighting source in automotive headlamp units. These lamps, however, exhibit low efficiency and short life because of the filament radiation employed thereby. These filaments are also relatively easily broken due to vibration, and it is bothersome if the frequency of changing lamps increases. Moreover, there is in demand a headlamp unit having a greater lumen output.

It is considered, therefore, to use high intensity discharge lamps, i.e., small metal halide discharge lamps, having high lumen efficiency and long life compared to incandescent lamps. However, it is well-known that it takes a long time, from about scores of seconds to several minutes, for such a high intensity discharge lamp to attain a stable lighting operation.

It is known to use high intensity reflector lamps using an arc lamp, as shown in U.S. Pat. No. 4,345,178, on commercial aircraft for night landings. It is easy to apply a lamp only for general lighting use.

However, it is not known to apply such high intensity discharge lamps directly for use for motor vehicles, especially for automobiles, because it cannot obtain a sufficient lumen output for safe driving immediately after lighting such a lamp. Instead, it is necessary to wait more than scores of seconds for safe driving after lighting when only using such lamps.

Moreover, as is known, it is necessary that an automotive headlight provide two kinds of beams, i.e., a high beam for lighting long distance (for use in open country) and a low beam for lighting short distance (for use when passing vehicles traveling in the opposite direction). It is, therefore, necessary to be able to change freely between these two beams as occasion calls.

SUMMARY OF THE INVENTION

Accordingly, an object of this invention is to provide a headlamp unit having both an incandescent lamp and a high intensity discharge lamp in the same unit.

Another object of this invention is to provide a headlamp unit having a long lighting life by using a high intensity discharge lamp.

Yet another object of this invention is to provide a head lamp unit having a sufficient lumen output even immediately after commencing lighting in spite of using a high intensity discharge lamp.

A further object of this invention is to provide a head lamp unit including an incandescent lamp for compensating for a lack of lumen output of a high intensity discharge lamp after commencing lighting.

These and other objects have been achieved according to this invention by providing a novel headlamp unit including an incandescent lamp and a high intensity discharge lamp each mounted in a common case body and having a respective reflective surface, and a lens attached to the case body.

BRIEF DESCRIPTION OF THE DRAWINGS

A more complete appreciation of this invention and many of the attendant advantage thereof will be readily obtained as the same becomes better understood by reference to the following detailed description when considered in connection with the accompanying drawings wherein.

DETAILED DESCRIPTION OF THE PREFERRED EMBODIMENTS

Figure 1:
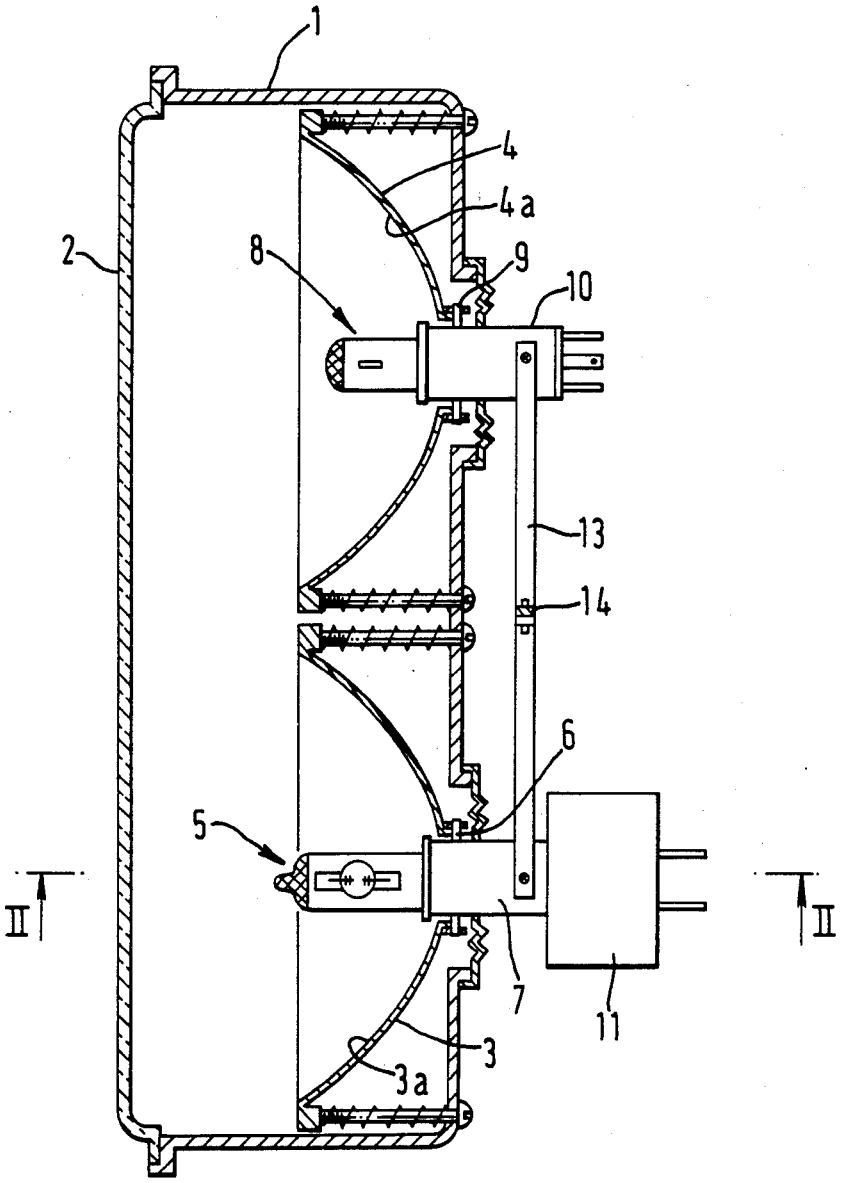
FIG. 1 is a transverse cross-sectional view of a headlamp unit according to this invention.
Figure 2:
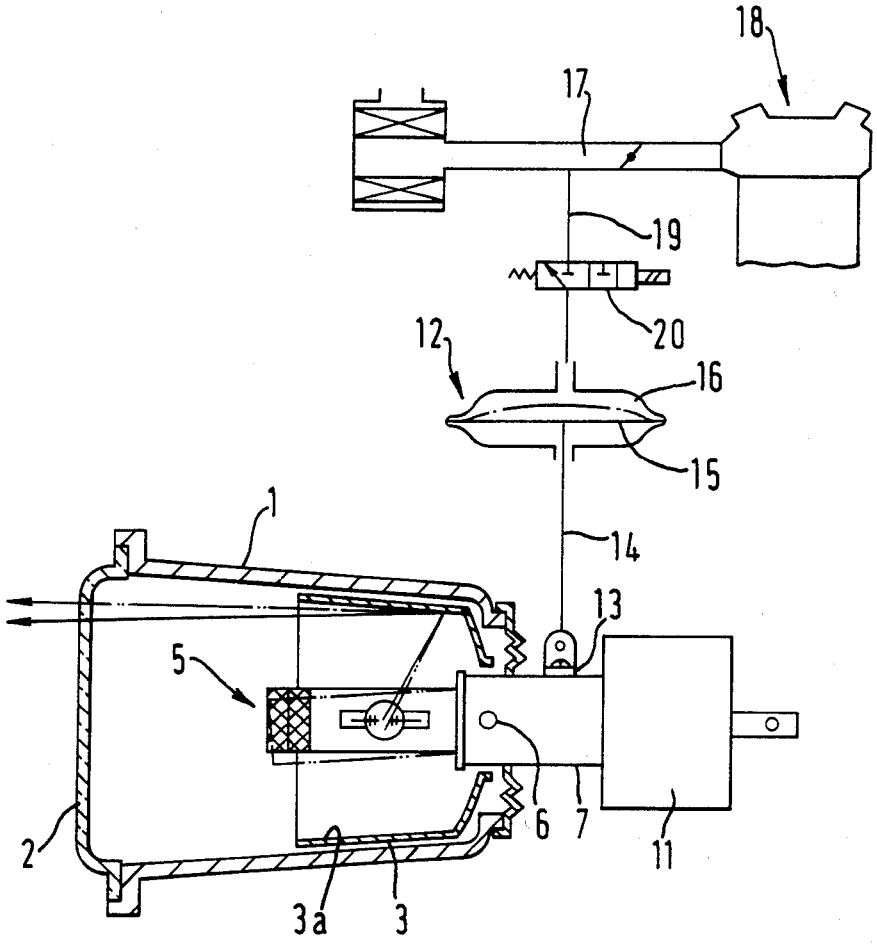
FIG. 2 is a cross-sectional view taken along the line II—II of FIG. 1.
Figure 3:
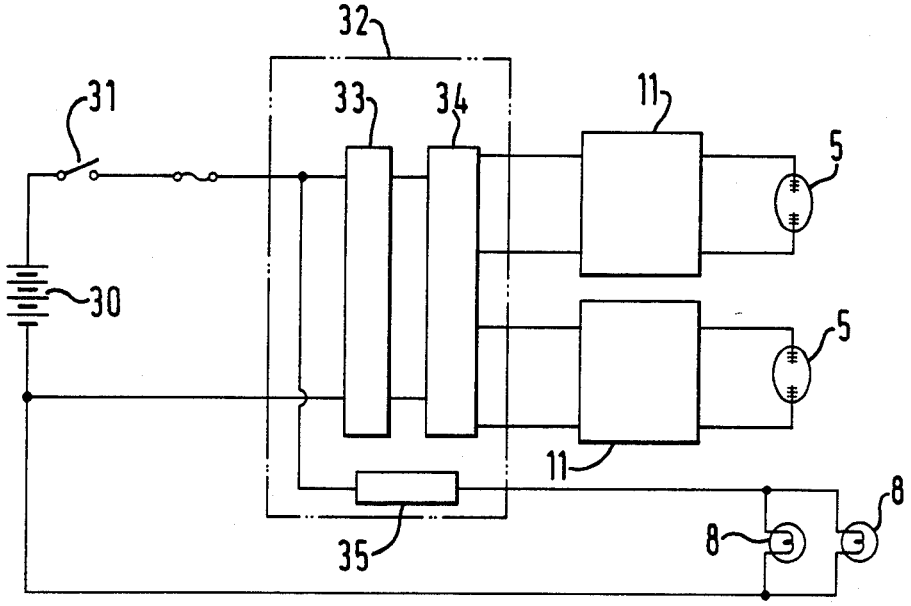
FIG. 3 is a schematic diagram of a circuit using the headlamp unit of FIG. 1.

Referring now to the drawings, wherein like reference numerals designate identical or corresponding parts throughout the several views, and more particularly to FIGS. 1, 2 and 3, thereof, the numeral 1 designates a body made of a synthetic resin. A lens 2 is mounted to a front opening of the case body 1. Two reflectors 3 and 4 are contained in the case body 1. These reflectors 3 and 4 have respective reflective surfaces 3*a* and 4*a* which are second revolution surfaces (parabolic surfaces). These reflective surfaces 3*a* and 4*a* are covered with a material, such as aluminum, by plating or by evaporation. In one of the reflectors, the reflector 3, a high intensity discharge lamp such a small metal halide discharge lamp 5 is disposed at about the focus of the reflector 3 so as to be movable by means of a pivot pin 6 fixed to a base 7 of the discharge lamp 5. On the other hand, an incandescent lamp such as a halogen lamp 8 is disposed at about the focus of the other reflector, the reflector 4, so as to be movable by means of a pivot pin 9 fixed to a base of the reflector 4. The numeral 11 designates a starting circuit unit of the headlamp unit.

The metal halide discharge lamp 5 and the halogen lamp 8 are operated so as to move together with a vacuum diaphram 12. Namely, the metal halide discharge lamp 5 and the halogen lamp 8 are connected with a lever 13 which is attached to each of the bases 7 and 10. The lever 13 is connected to a link 14, and this link 14 is connected to a diaphragm 15. A pressure room 16 divided by the diaphragm 15 is connected to an intake passage 17 of an engine 18 by way of a passage 19. The passage 19 is operated so as to be opened and closed by means of an electromagnetic valve 20. When the electromagnetic valve 20 is operated so as to be opened during operation of the engine 18, the diaphram 15 is deformed as is shown in the phantom line in FIG. 2 owing to negative pressure in the pressure room 16. The lever 13, therefore, is lifted up by way of the link 14, so the metal halide discharge lamp 5 and the halogen lamp 8 are respectively moved a short distance around the pivot pins 6 and 9 acting as fulcrums. As is shown in the phantom line in FIG. 2, the reflected beam of the metal halide discharge lamp 5 becomes a high beam. As the movement of both the metal halide discharge lamp 5 and the halogen lamp 8 is operated at the same time as above-mentioned, the reflected beams of both lamps 5 and 8 are directed in the same direction, i.e., as either a high beam or a low beam.

The lighting operation in the construction of the lamps 5 and 8 as shown in FIGS. 1 and 2 is controlled by the lighting circuit shown in FIG. 3. The numeral 30 designates an electric power source, the numeral 31 designates a switch of a headlamp unit and the numeral 32 designates a control circuit. The control circuit 32 provides a stepping up circuit 33 and a ballast circuit 34. The stepping up circuit 33 operates so as to raise 12 V of the power source 30 to about 200 V which is necessary for the metal halide lamp 5 to light. The ballast circuit 34 operates so as to stabilize the voltage during the lighting of the discharge lamp 5. The control circuit 32 also provides a timer 35 which automatically stops the current supply to the halogen lamp 8 when the metal halide discharge lamp 5 begins stable lighting operation. The starting circuit 11 operates so as to generate a pulse voltage of about 1,000 V to 10,000 V for starting the metal halide discharge lamp 5.

According to the above-mentioned first embodiment of this invention, the switch 31 is turned on, the voltage of the electric power 30 is supplied not only to the both metal halide discharge lamps 5 and 5 by way of the control circuit 32 and the starting circuit 11 but also to the both halogen lamps 8 and 8. The discharge lamps 5 and 5 and the halogen lamps 8 and 8, therefore, begin to light. After starting of the metal halide discharge lamps 5 and 5, these lamps do not produce a sufficient lumen output for driving purpose because the lamps 5 and 5 are not operating in a stable lighting condition. In contrast, the halogen lamps 8 and 8 being to light stably from the beginning of lighting, as is known. Therefore, the low lumen output of the metal halide discharge lamps 5 and 5 for initial starting period after lighting is compensated with the lumen output of the halogen lamps 8 and 8. It is possible, therefore, to drive an automobile immediately after switching on the headlamp by using the lumen output of the halogen lamps 8 and 8. From scores of seconds to several minutes after lighting of the discharge lamps, the lighting operation of the metal halide discharge lamps 5 and 5 becomes stable and produces a sufficient lumen output. The operation of the halogen lamps 8 and 8 is then stopped by means of the operation of the timer 35 when the metal halide discharge lamps 5 and 5 begin stable lighting operation. Thereafter, only the metal halide lamps 5 and 5 work as the lighting source of the headlamp unit.

When it is necessary to operate a low beam immediately after lighting, it can be got by closing the passage 19 with the operation of the electromagnetic valve 20. When it is necessary to operate a high beam (as is shown phantom line in FIG. 1) immediately after lighting, it can be got by producing a negative pressure in the pressure room 16, as aforementioned, by opening the passage 19 upon operation of the electromagnetic valve 20. In both cases, the halogen lamp 8 operates as the lighting source of the headlamp unit until the metal halide discharge lamp 5 begins stable lighting operation. Namely, the halogen lamp 8 compensates for the lack of the full lumen output of the metal halide discharge lamp 5 until the metal halide discharge lamp 8 operates stably.

According to the above-mentioned embodiment, the halogen lamp 8 can be used for a long time because the halogen lamp 8 is used only during the period until the metal halide discharge lamp 5 begins stable lighting operation. The metal halide discharge lamp 5 has essentially 3–5 times as long an operating life compared to the halogen lamp 8. Thereafter, the headlamp unit has a long life. Moreover, high beam and low beam operation of the headlamp unit can be got freely only by moving the both lamps 5 and 8.

It should be understood, however, that the present invention is applicable as well to the use of one reflector body having two reflector portions, instead of using two independent reflectors. Moreover, a high beam and a lower beam can be got by moving the lamps 5 and 8 as above-described, but it may otherwise be got by moving the case body 1 containing the lamps 5 and 8 instead of moving the lamps 5 and 8 themselves. Namely, high or low beam selection can be got by connecting a link 14 of a vacuum diaphram 12 to a case body 1 instead of lamp bases 7 and 10. As an alternate means for moving the lamps or the case body, a solenoid actuator or an oil pressure actuator, etc. may be employed.

Figure 4:
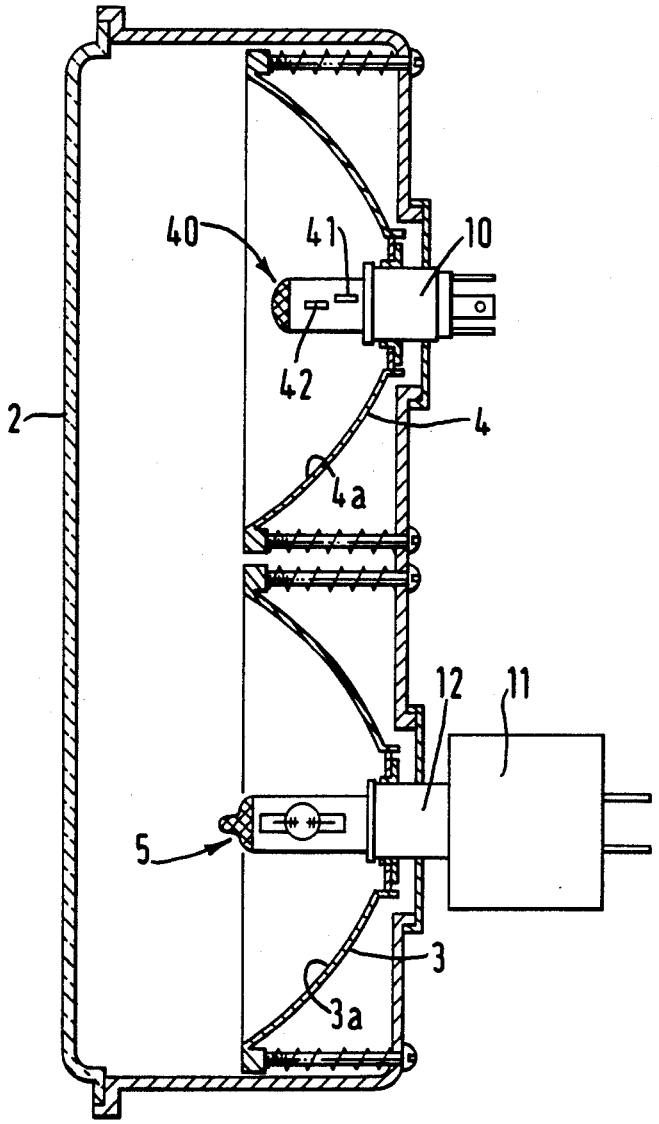
FIG. 4 is a transverse cross-sectional view of an alternate embodiment of the headlamp unit of FIG. 1.

FIG. 4 shows a further embodiment of the invention. In this embodiment, a high beam or a low beam can be got without mechanically moving the lamp or the case body as in the first embodiment. A small metal halide discharge lamp 5 is disposed at about the focus of a reflector 3 so as to have always a low beam. The metal halide discharge lamp 5 is connected to a starting circuit unit 11 by way of a base 7. A halogen lamp 40, having two filaments, i.e., a low beam filament 41 and a high beam filament 42, is disposed at about the focus of the reflector 4.

Figure 5:
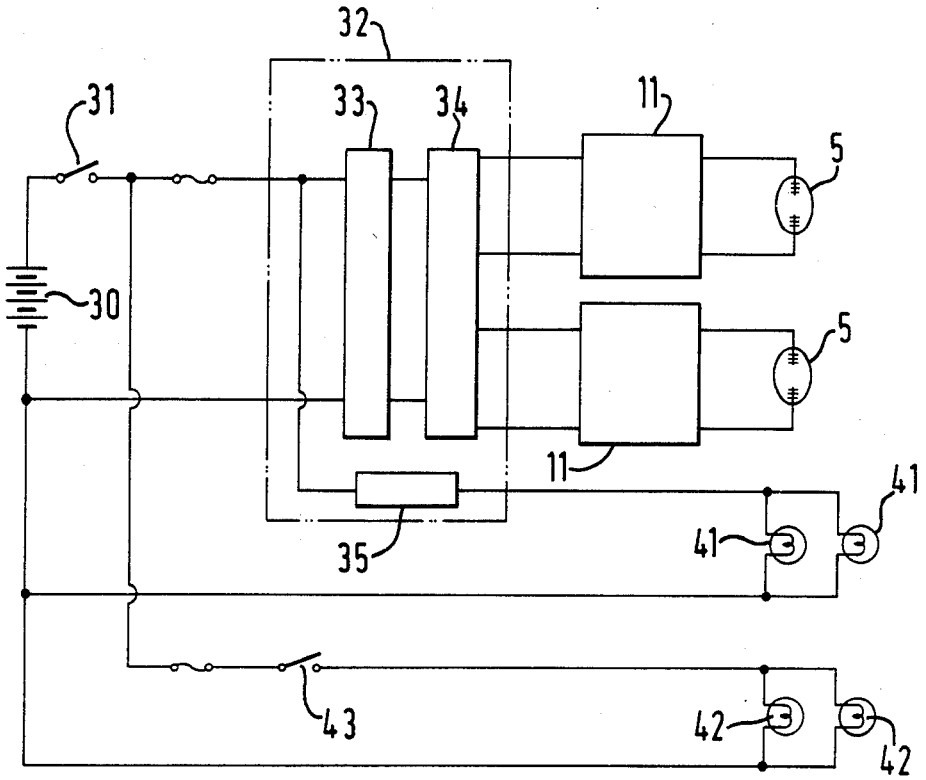
FIG. 5 is a schematic diagram of a circuit using the headlamp unit of FIG. 4.

The lighting operation of the metal halide discharge lamp 5 and the halogen lamp 40 is controlled by the lighting circuit shown in FIG. 5. The lighting circuit is almost the same as the first embodiment. The low beam filament 41 of the halogen lamp 40 is connected to a timer 36 and the high beam filament 42 of the halogen lamp 40 is connected to an electric power source 31 by way of a switch 43 for producing a high beam.

In such a construction, when it is necessary to have a low beam, turning on of the switch 31 begins lighting of the metal halide discharge lamp 5 and the low beam filament 41 of the halogen lamp 40. Although at starting insufficiently bright low beam lighting can be obtained from only the metal halide discharge lamp 5, at starting, the low beam filament 41, however, lights immediately after turning on the switch 32 and provides sufficiently bright low beam lighting for automotive driving. When the metal halide discharge lamp 5 attains stable lighting operation (i.e., sufficiently bright low beam for driving) after a predetermined time period, the filament 41 is switched out of operation by the timer 35. After that, the metal halide discharge lamp 5 alone works as a low beam source. When it is necessary to have a high beam in this situation, it can be got by using the high beam filament 42 of the halogen lamp 40. Namely, it can be got by adding the low beam illumination of the discharge lamp 5 to the high beam illumination of the halogen lamp 42.

Moreover, when it is necessary to have a high beam immediately after lighting, it can be got by using only the halogen lamp 40 without using the discharge lamp 5. Namely, it can be got by adding the low beam illumination of the low beam filament 41 to the high beam illumination of the high beam filament 42. The metal halide discharge lamp 5 is used in place of the filament 41 of the halogen lamp 40 as the low beam illumination source after the metal halide discharge lamp 5 attains stable lighting.

It should be understood, however, that the invention is applicable as well as to the use of a light sensor for controlling the switching off of the halogen lamp based on the lumen output of the discharge lamp. Moreover, a small high pressure mercury lamp, a small high pressure sodium lamp and an incandescent lamp can be used respectively instead of using a small metal halide discharge lamp and a halogen lamp.

According to this invention, there is provided a headlamp unit having long life because of using a small high intensity discharge lamp as a lighting source. Moreover, a small high intensity discharge lamp is used together with an incandescent lamp, whereby there is produced a sufficient lumen output for driving even immediately after starting lighting of the headlamp unit. Furthermore, the operating time of the incandescent lamp is short because it is used only until the discharge lamp attains stable lighting or only for use as a high beam source.

Obviously, numerous other modifications and variations of this invention are possible in light of the above teachings. It is therefore to be understood that within the scope of the appended claims, the invention may be practiced otherwise than as specifically described herein.

What is claimed as new and desired to be secured by Letters Patent of the United States is:

1. A headlamp unit for motor vehicles comprising:

a first light beam unit which comprises:

an incandescent lamp;

a first reflector means for reflecting light from said incandescent lamp wherein said incandescent lamp is disposed at about a focus of said first reflector means;

a second light beam unit which comprises;

a high intensity discharge lamp;

a second reflector means for reflecting light from said high intensity lamp, wherein said high intensity light is disposed at about a focus of said second reflector means;

timing means for stopping the lighting of said first light beam unit after a predetermined time approximating the time necessary for said second light beam unit to obtain a stable operation;

means for providing a high beam from said first light beam unit;

means for providing a high beam from said second light beam unit;

means for providing a low beam from said first light beam unit; and means for providing a low beam from said second light beam unit.

2. A headlamp unit for motor vehicles comprising:

a first light beam unit which comprises;

a multi-filament incandescent lamp;

a first reflector means for reflecting light from said incandescent lamp, wherein said incandescent lamp is disposed at about a focus of said first reflector means;

a low beam light unit which comprises;

a high intensity discharge lamp;

a second reflector means for reflecting said high intensity lamp, wherein said high intensity lamp is disposed at about a focus of said second reflector means;

means for providing a low beam from one of the filaments of said incandescent lamp in said first light beam unit when said high intensity discharge lamp is not in stable operation;

means for providing a low beam from said low beam light unit when said high intensity discharge lamp has obtained stable operation;

means for providing a high beam from a plurality of the filaments of said incandescent lamp of said first light beam unit when said high intensity lamp of said low beam light unit has not obtained stable operation;

means for providing a high beam from one of said filaments of said incandescent lamp of said first light unit and from said high intensity lamp of said low beam unit when said low beam light unit has not obtained stable operation;

means for switching off at least one filament of said multi-filament incandescent lamp when the operation of said high intensity discharge lamp obtains stable operation.

* * * * *